US005108611A

United States Patent [19]

Chen et al.

[11] Patent Number: 5,108,611

[45] Date of Patent: Apr. 28, 1992

[54] METHOD OF PREPARING COUPLER DISPERSIONS FOR PHOTOGRAPHIC USE

[75] Inventors: Stephen P. Chen, Webster; Edgar P. Lougheed, Byron; Carl B. Richenberg, Batavia, all of N.Y.

[73] Assignee: Eastman Kodak Company, Rochester, N.Y.

[21] Appl. No.: 745,669

[22] Filed: Aug. 16, 1991

[51] Int. Cl.[5] ..... G03C 7/32

[52] U.S. Cl. ..... 210/637; 210/644; 210/651; 210/500.23; 430/546

[58] Field of Search ..... 210/637, 641, 644, 651, 210/500.23; 430/377, 449, 546

[56] References Cited

U.S. PATENT DOCUMENTS 4,233,397 11/1980 Tada et al. ..... 430/449

5,024,929 6/1991 Longheed et al. ..... 210/644 X

*Primary Examiner*—Frank Spear

*Attorney, Agent, or Firm*—Robert A. Gerlach

[57] ABSTRACT

A method of preparing a coupler dispersion in gelatin by separating the auxiliary coupler solvent using a hydrophobic microporous membrane and contacting the opposite surface of the membrane with a coupler solvent.

27 Claims, 1 Drawing Sheet

METHOD OF PREPARING COUPLER DISPERSIONS FOR PHOTOGRAPHIC USE

BACKGROUND OF THE INVENTION

1. Field of the Invention

This invention relates to a method of preparing coupler dispersions for photographic use and more particularly to a method of preparing coupler dispersions being substantially free of auxiliary coupler solvents by a membrane separation technique.

2. Description of Related Art

In the manufacture of film dispersions a photographic coupler is dissolved in a permanent coupler solvent with the addition of an auxiliary coupler solvent that assists in the dissolution of the coupler in the permanent coupler solvent. This solution is mixed under high shear, together with an aqueous gelatin solution generally containing a surfactant, at elevated temperatures in order to break the organic phase into sub-micron droplets dispersed in the continuous aqueous phase.

Subsequently, the dispersion is chilled and extruded into "noodles" which are approximately three millimeters in diameter. These noodles are washed for several hours in an abundance of water with agitation to extract the auxiliary coupler solvent. The noodles are drained over night to reduce the water content. The entire process takes on the order of one day, is labor intensive and is inefficient due to coupler loss which occurs mainly during the washing process. Various aspects of this noodling procedure are disclosed in the following U.S. Pat. Nos. 2,322,027; 2,801,170; 2,801,171; 2,949,360; and 3,396,027. Another disadvantage of the noodling procedure, that is also mentioned in several of the above-mentioned patents, is that the coupler has a tendency to crystallize in the emulsion upon the removal of the auxiliary coupler solvent. This has associated disadvantages in that the coupler reacts less readily in the color forming reaction, this being the prime function in the photographic element.

U.S. Pat. No. 4,233,397 removes the auxiliary solvent from a coupler dispersion by contacting the coupler dispersion containing the auxiliary solvent through a hydrophobic macroporous film made of polytetrafluorethylene or polypropylene with an auxiliary solvent-carrying fluid medium. The auxiliary solvent-carrying fluid medium is water, air and non-reactive gases saturated with water and aqueous solutions of compounds that increase the solubility of the auxiliary solvent in water, such as glycerin, ethylene glycol, formamide and dimethylformamide. The hydrophobic membrane has an average pore size of about 0.1 to 40 micrometers preferably from 0.1 to 5 micrometers.

SUMMARY OF THE INVENTION

The invention contemplates a process of separating the auxiliary coupler solvent from a dispersion containing droplets of an organic discontinuous phase containing a coupler, a coupler solvent and an auxiliary coupler solvent in a continuous aqueous phase of gelatin in water by a membrane separation wherein the auxiliary coupler solvent is removed from the discontinuous organic phase of the dispersion by passing the dispersion over one surface of a microporous membrane while passing an organic solvent over the other surface of the membrane, the time of the separation being sufficient to reduce the concentration of the auxiliary coupler solvent in the dispersion to less than 1 weight percent. By organic solvent is meant an organic material, liquid at the processing temperature and having a partition coefficient for the auxiliary coupler solvent grater than 1 when equilibrium with water and having a solubility in water of less than 1 percent by weight. Suitable materials include hydrocarbons such as hexane, heptane, hexadecane, octane, nonane, decane, dodecine tetradecane, alcohols such as hexanol heptanol, octanol, dodecanol, tetradedecanol and the like, and commonly known coupler solvents.

BRIEF DESCRIPTION OF THE DRAWING

The sole FIGURE is a diagrammatic flow chart illustrating the claimed invention.

DESCRIPTION OF THE PREFERRED EMBODIMENTS

Figure 1:
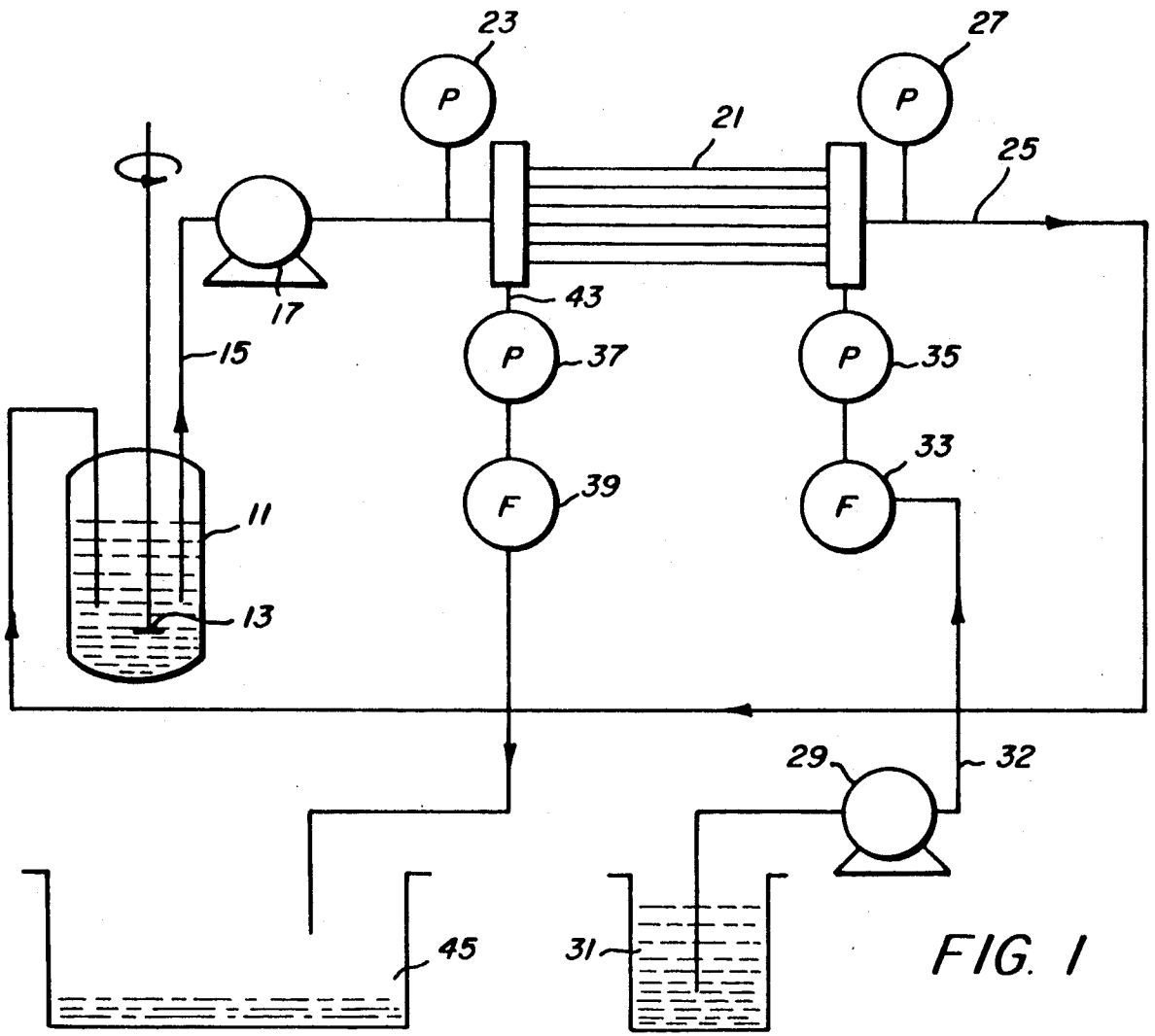

The invention provides a method of preparing a coupler dispersion in an aqueous gelatin medium by milling under high shear a coupler, a coupler solvent and an auxiliary coupler solvent with an aqueous gelatin solution to form a discontinuous organic phase of finely divided droplets containing the coupler, the coupler solvent and the auxiliary coupler solvent, in a continuous aqueous phase of gelatin in water and separating the auxiliary coupler solvent from the organic phase of the dispersion by passing the dispersion over one surface of a microporous membrane at a first pressure while passing an organic solvent over the other surface of the membrane at a second pressure for a time sufficient to reduce the concentration of the auxiliary coupler solvent in the dispersion to a concentration less than 1 weight percent preferably less than 0.3 weight percent and most preferably less than 0.1 weight percent. The first pressure must be greater than the second pressure at all points across the membrane when a hydrophobic membrane is used. The pressure differential across the hydrophobic membrane at all points preferably should be at least 0.5 psi, more preferably 0.5 to 5 psi and most preferably 1 to 2 psi to achieve separation in reasonable times. When a hydrophilic membrane is used the first pressure must be lower than the second pressure at all points. The pressures differential across a hydrophilic membrane should be at least 0.5 psi and preferably at least 1 psi or higher depending upon the materials and process conditions.

It is preferred that the separation be conducted above the point of incipient gelation, that is, the temperature below which gelation of the dispersion commences. This temperature will vary depending upon the exact physical conditions present and the constitution of the dispersion. The temperature preferably should be maintained about 10° C. above this temperature and preferably within about 5° C. above this temperature in order to promote membrane solvent extraction.

While a single planar membrane may be employed in accordance with this invention, by passing each of the compositions over opposite surfaces thereof through chambers that are divided by the membrane, it is preferred that membranes be employed in a configuration that provides a maximum surface area for conducting the process. In this regard, hollow fiber membrane modules are employed. The microporous membranes employed in accordance with this invention include both hydrophobic materials and hydrophilic materials. Any suitably hydrophobic membrane material may be used, such as polycarbonates, polysulfones, polyacrylates such as, polymethylmethacrylate, polyhalohydrocarbons including polytetrafluoroethylene, polyvinylidene fluoride, polyvinylidene chloride, polychloradifluoroethylene and the like; polyolefins including polyethylene, polypropylene, polybutylene copolymers such as, polyethylene-co-vinyl alcohol and the like. Any suitable hydrophilic membrane material may be used, such as, cellulose, cellulose acetate, polyacryonitrile, polyacryonitrile-sodium methallyl sulfonate and the like. Hydrophobic microporous membranes are preferred. Particularly suitable membranes are polyolefin membranes, particularly polypropylene sold under the trademark Celgard microporous hollow fibers sold by Hoechst Celanese, Separation Products Division, Charlotte, N.C. 28217.

By "microporous membrane" is meant one having an effective average pore size of less than the size of the organic droplets in the dispersion, preferably less than about 1000 angstroms more preferably less than 500 angstroms and most preferably less than 300 angstroms. In hollow fiber membrane modules, the dispersion containing the auxiliary coupler solvent is flowed over one surface of the fibers, that is, it is either flowed through the lumen of the fibers or on the shell side of the fibers while a coupler solvent is flowed on the opposite side of the hollow fibers. In a preferred embodiment of this invention, the dispersion containing the auxiliary coupler solvent is flowed through the lumen of the fibers of a hollow fiber membrane module and the same coupler solvent as is employed in the preparation of the dispersion is flowed on the shell side. This is advantageous in that the collected coupler solvent/auxiliary coupler solvent mixture recovered can be reused directly in the formation of coupler dispersions merely by adjusting the proportion of each present. A particularly suitable commercially available membrane module for conducting the process in accordance with this invention is sold by Hoechst Celanese under the trade designation F-240/22 wherein the hollow fibers are polypropylene having an average effective pore size of 300 angstrom. This device is approximately 30.5 centimeters in length and 5 centimeters in diameter. It contains 10,800 fibers having an ID of 240 $\mu$m yielding an effective membrane surface area of 2.0 square meters.

The direction of flow within the lumen of the hollow fibers with respect to the direction of flow in the shell may be counter-current, co-current or transverse. When a hydrophobic membrane is employed the pressure on the dispersion is greater everywhere than the pressure on the solvent. Thus, when the dispersion is flowed through the lumen, and the solvent through the shell in counter-current relation, this pressure requirement is satisfied as long as the pressure at the outlet of the lumen is greater than the pressure at the shell inlet ($P_{lo}>P_{si}$). This insures that a positive pressure across the hollow fiber membrane exists at every point on the membrane since the pressure at the lumen input is always greater than the pressure at the lumen output ($P_{li}>P_{lo}$) and the pressure at the shell input is always greater than the pressure at the shell output ($P_{si}>P_{so}$). When the flow within the lumen is co-current with that in the shell, and the dispersion is flowed through the lumen and the solvent through the shell, the pressure at the lumen input must be greater than the pressure of the shell input for the pressure across the lumen to be greater on the lumen side at all points. When the membrane is hydrophilic and counter current flow is employed, $P_{so}>P_{li}$ applies. When co-current flow conditions are employed, the expressions $P_{so}>P_{lo}$ and $P_{si}>P_{li}$ apply.

Counter-current flow is preferred as it gives faster separations.

In the practice of this invention, a dispersion is prepared by initially dissolving a coupler in a permanent coupler solvent and an auxiliary coupler solvent which assists in the dissolution of the coupler in the solvent system. A second solution containing a gelatin solution in water together with a surfactant is then mixed with the coupler-solvent solution under high shear agitation in a suitable device such as, a duplixer, a colloid mill, a homogenizer and the like, preferably at elevated temperatures of from about 150° F. to about 210° F. to break the organic phase into submicron droplets which are dispersed in the continuous aqueous phase. The unwashed dispersion is charged into glass feed vessel 11, shown in the FIGURE equipped with a stirrer 13. The dispersion from vessel 11 is pumped by means of pump 17 through conduit 15 to the lumen portion of hollow fiber membrane 21. A pressure gauge 23 is located in conduit 15 to enable the recording of the inlet pressure to the hollow fiber membrane module 21. The dispersion passes through the lumens of the membrane fibers and outlets through conduit 25 and is returned by conduit 25 back to vessel 11. Pressure gauge 27 is located to enable the recording of the outlet pressure and thereby the pressure drop through the lumens of the hollow fiber membrane module.

An organic solvent is pumped by means of pump 29 from reservoir 31 through conduit 32 through a rotometer flow meter 33 pressure gauge 35 and then through the shell portion of hollow fiber membrane module 21 exiting through conduit 43 that delivers the solvent to reservoir 45. Within conduit 43 are positioned pressure gauge 37 and rotometer flow meter 39 to enable the reading and recording of the outlet conditions from the shell portion of hollow fiber membrane module 21. As indicated above, there must be a positive pressure drop across the hollow fiber membrane from the lumen side (dispersion side) to the shell side (solvent side) when a hydrophobic membrane is employed. Therefore the pressure reading on pressure gauge 27 must be maintained greater than the pressure reading on gauge 37 in order to insure this condition. The temperature of vessel 13 containing the unwashed coupler dispersion, the hollow fiber membrane module 21 and the solvent reservoir 31 together with the associated hardware is capable of being controlled by a temperature control means (not shown). One suitable means for controlling the temperature of these components of the system is a constant temperature bath. If it is desired for either component i.e., the coupler dispersion or the solvent to be temperature controlled individually, different baths for example, may be employed for each of the reservoirs and accompanying conduit means.

In another embodiment, the method employing an organic solvent as the extraction medium may be used in series with other separation techniques. For example, the above described method may be employed in series with that described in U.S. patent application Ser. No. 07/516,955 filed Apr. 30, 1990 assigned to the same assignee as this application, the disclosure of which is wholly incorporated herein by reference which describes an aqueous membrane separation technique employing an hydrophilic membrane. While the method of this invention can be conducted either before or after the separation technique employing an aqueous hydrophilic membrane separation, it is preferred that it be conducted after the method of the above-mentioned application as that method also removes surfactant from the dispersion, thus lowering the viscosity and thereby more readily enabling the control of the pressure drop across the membrane in the solvent extraction method described herein.

In addition to the above, the system apparatus may be provided with a cone filter at the intake point of the lumen stream in order to prevent plugging of the fiber membranes due to gel slugs.

The process in accordance with this invention is applicable for the formation of dispersions containing all types of couplers such as those set forth UK Patent No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. Nos. 2,343,703, 2,376,380 and 2,369,489, Spath U.K. Patent No. 886,723 and U.S. Pat. No. 2,899,306, Tuite U.S. Pat. No. 3,152,896 and Mannes et al U.S. Pat. Nos. 2,115,394, 2,252,718 and 2,108,602, ad Pilato U.S. Pat. No. 3,547,650. In this form the developer contains a color-developing agent (e.g., a primary aromatic amine) which in its oxidized form is capable of reacting with the coupler (coupling) to form the image dye. The dye-forming couplers can be incorporated in different amounts to achieve differing photographic effects. For example, U.K. Patent No. 923,045 and Kumai et al U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Patent No. 969,921, U.S. Pat. No. 1,241,069, U.K. Patent No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Patent No. 975,928, U.K. Patent No. 1,111,554, Jaeken U.S. Pat. No. 3,222,176 and Canadian Patent No. 726,651, Schulte et al U.K. Patent No. 1,248,924 and Whitmore et al U.S. Pat. No. 3,227,550.

Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Patent No. 1,201,110, Oishi et al U.S. Pat. No. 3,462,485, Verbrugghe U.K. Patent No. 1,236,767, Fujiwhara et al U.S. Pat. No. 3,770,436 and Matsuo et al U.S. Pat. No. 3,808,945. Dye-forming couplers and nondye-forming compounds which upon coupling release a variety of photographically useful groups are described in Lau U.S. Pat. No. 4,248,962. DIR compounds which do not form dye upon reaction with oxidized color-developing agents can be employed, as illustrated by Fujiwhara et al German OLS No. 2,529,350 and U.S. Pat. Nos. 3,928,041, 3,958,993 and 3,961,959, Odenwalder et al German OLS No. 2,448,063, Tanaka et al German OLS No. 2,610,546, Kikuchi et al U.S. Pat. No. 4,049,455 and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129.

Particular couplers which may be used according to the invention are those disclosed in U.S. Pat. Nos. 2,322,027; and the following: (1)

(1) 1-hydroxy-2-[o-(2',4'-di-tert amylphenoxy)-n-butyl]-naphthamide (U.S. Pat. No. 2,474,293)

(2) 1-hydroxy-4-phenylazo-4'-(p-tert butylphenoxy)-2-naphthanilide (U.S. Pat. No. 2,521,908)

(3) 2-(2,4-di-tert amylphenoxyacetamino)-4,6-dichloro-5-methyl phenol (Graham U.S. Pat. No. 2,725,291)

(4) 2-(α-Di-tert amylphenoxy-n-butyrylamino)-4,6-dichloro-5-methyl phenol (5) 6-{{α-{4-[α-(2,4-di-tert amylphenoxy)butylamido]-phenoxy}-acetamido}}-2,4-dichloro-3-methyl phenol (6) 2-[3'-(2'',4''-diamylphenoxy)-acetamido]benzamido-4-chloro-5-methyl phenol (7) 1-(2',4',6'-trichlorophenyl)-3-[3''-(2''',4'''-di-tert amylphenoxy-acetamido)benzamido[-5-pyrazolone (U.S. Pat. No. 2,600,788)

(8) 1-(2',4',6',-trichlorophenyl)-3-[3''-(2''',4'''-di-tert-amylphenoxy-acetamido-benzamido]-4-(p-methoxy-phenylazo)-5-pyrazolone (9) N-(4-benzoylacetaminobenzenesulfonyl)-N-(γ-phenylpropyl)-p-toluidined (U.S. Pat. No. 2,298,443)

(10) α-o-methoxybenzoyl-α-chloro-4-[α-(2,4-di-tertamylphenoxy)-n-butylamido)acetanilide (McCrossen U.S. Pat. No. 2,728,658)

(11) α-{3-[α-(2,4-di-tert amylphenoxy)acetamido]benzoyl}2-methoxy-anilide

(12) 3-benzoylacetamino-4-methoxy-2',4'-di-tert amylphenoxyacetanilide

(13) 4-benzoylacetamino-methoxy-2',4'-di-tert amylphenoxyacetanilide

The terms "coupler solvents" and "auxiliary coupler solvents" are terms widely used in the photographic industry and are understood by those working in this environment. Coupler solvents are substantially water insoluble, of low molecular weight and have a boiling point above about 175° C. at atmospheric pressure and a high solvent action for the coupler and dyes formed therefrom, and are permeable to photographic developer oxidization products. Auxiliary coupler solvents enhance the coupler solubility and have a water solubility within the range of from about 2.5 to 100 parts of solvent per 100 parts of water.

Suitable coupler solvents include alkyl esters of phthalic acid in which the alkyl radical preferably contains less than 6 carbon atoms, for example, methylphthalate, ethylphthalate, propylphthalate and n-butylphthalate, di-n-butylphthalate, n-amylphthalate, isoamylphthalate and dioctylphthalate, 1,4-cyclohexylene dimethylene bis(2-ethyl hexanoate), 2,4-di-tert-amyl phenol, esters of phosphoric acid, for example, triphenylphosphate, tri-o-cresylphosphate and diphenylmono-p-tert.butylphenyl phosphate, and alkyl amides or acetanilides, for example, N,n-butylacetanilide and N-methyl-p-methyl acetanilide. The coupler solvents preferably have a water solubility of less than about 0.1 part of solvent in 100 parts of water and are generally employed in amounts less than 1 part of coupler solvent per part of coupler by weight.

Suitable auxiliary coupler solvents include esters of aliphatic alcohols with acetic or propionic acid, for example, ethylacetate, isopropyl acetate, ethylpropionate, beta-ethoxyethyl acetate, 2-(2-butoxy-$\beta$-ethoxy)ethyl acetate, cyclohexanone, triethyl phosphate and the like. The coupler solvents and auxiliary coupler solvents set forth in U.S. Pat. No. 2,949,360, which is incorporated herein by reference are suitable in the practice of this invention. An added advantage to the process in accordance with this invention is that compounds heretofore unsuitable for use as auxiliary coupler solvents because of inherent characteristics, such as, odor for example, can be employed since the system is closed and full recovery of the solvent is readily obtained.

The invention is further illustrated by the following examples:

EXAMPLE 1

Preparation of Unwashed Dispersion

In a first container, 410 grams of a photographic coupler (1-(2,4,6-tricholorophenyl)-3-[$\alpha$-(3-tert.butyl-4-hydroxyphenoxy)-tetradecanamido-2-chloro-anilino]-4-(3,4-dimethoxy)-phenylazo-5-pyrazolone) are dissolved in 810 grams of a coupler solvent (tri-o-cresylphosphate) and 610 grams of auxiliary coupler solvent 2(2-butoxyethoxy)ethyl acetate. To a separate container are added 740 grams of gelatin, 74 grams of a surfactant which is a mixture of monomers, dimers, trimers and tetramers of the sodium salt of isobutylnaphthalene sulfonic acid, sold by DuPont Company under the trade designation ALKANOL XC, and 7,356 grams of distilled water. The coupler-coupler solvent-auxiliary coupler solvent from the first container is mixed with the water-gelatin-surfactant from the second container in a high shear duplixer at a temperature of from about 150° F. to about 210° F. to break the coupler organic phase into sub-micron droplets which are dispersed in the continuous aqueous phase. This dispersion containing 4.1 percent by weight of coupler, 8.1 percent by weight of coupler solvent, 6.1 percent by weight of auxiliary coupler solvent, 7.4 percent by weight of gelatin, 0.74 percent by weight of surfactant and the balance water is utilized as a master batch for conducting the membrane solvent extraction in accordance with this invention described hereinafter.

EXAMPLE 2

One kilogram of the master batch dispersion prepared in Example 1 is transferred to glass feed vessel 11 shown in FIG. 1. The dispersion is pumped by means of pump 17 through the lumen of the hollow fiber membrane module 21 while 1 kg of tri-o-cresylphosphate from container 31 is pumped counter-currently through the shell portion of the hollow fiber membrane module 21 and then returned back to container 31. The hollow fibers of the module are microporous polypropylene having an I.D. of 240 $\mu$m and a membrane area of 2 meters square. The lumen flow is maintained at 350 g/min while the shell flow at 55 g/min. The temperature of the entire apparatus as shown in FIG. 1 is maintained at 40° C. Samples of the dispersion and the shell stream are taken at different time intervals to measure the transport of the auxiliary coupler solvent across the membrane. A concentration of about 1 weight percent of auxiliary solvent in the dispersion is reached upon operating the membrane solvent extraction for only 20 minutes. The concentration of coupler solvent in the dispersion remains virtually constant over this time period. In order to keep the volume of the dispersion constant in vessel 11, 120 milliliters of warm distilled water are added over the course of the 140 minutes. This addition of water indicates that diffusion is the prime method for removing the auxiliary coupler solvent from the dispersion, the small amount of water added indicating that some ultrafiltration is taking place. Throughout the example, a positive pressure greater than 2 psi is applied from the lumen stream to the shell stream.

It should be understood that suitable coupler dispersions can be prepared using any of the couplers, coupler solvents and auxiliary coupler solvents set forth above in accordance with the procedure of the procedures indicated above and particularly in the examples.

What is claimed is:

1. A method of preparing a coupler dispersion in gelatin which comprises milling a coupler, a coupler solvent and an auxiliary coupler solvent with an aqueous gelatin solution to form a dispersion having a discontinuous organic phase of submicron droplets containing the coupler, coupler solvent and auxiliary coupler solvent in a continuous aqueous phase of gelatin in water, separating the auxiliary coupler solvent from the organic phase by passing the dispersion containing the auxiliary coupler solvent over one surface of a microporous membrane while passing an organic solvent over the other surface of the membrane.

2. The method of claim 1 wherein the microporous membrane is a hydrophobic microporous membrane and a pressure drop is maintained across the membrane from the dispersion side of the membrane to the solvent side of the membrane.

3. The method of claim 2 wherein the pressure drop is at least 0.5 psi.

4. The method of claim 2 wherein the pressure drop is from 0.5 to 5 psi.

5. The method of claim 2 wherein the pressure drop is 1 to 2 psi.

6. The method of claim 1 wherein the microporous membrane is a hydrophilic microporous membrane and a pressure drop as maintained across the membrane from the solvent side of the membrane to the dispersion side of the membrane.

7. The method of claim 6 wherein the pressure drop is at least 0.5 psi.

8. The method of claim 6 wherein the pressure drop is at least 1 psi.

9. The method of claim 1 wherein a surfactant is added to the aqueous gelatin solution.

10. The method of claim 1 wherein the average effective pore size of the microporous membrane is less than 1000 angstroms.

11. The method of claim 6 wherein the average effective pore size of the microporous membrane is less than 500 angstroms.

12. The method of claim 6 wherein the average effective pore size of the microporous membrane is less than 300 angstroms.

13. The method of claim 1 wherein the organic solvent is a member selected from the group consisting of hydrocarbons, alcohols and coupler solvents.

14. The method of claim 13 wherein the organic is a hydrocarbon.

15. The method of claim 13 wherein the organic is an alcohol.

16. The method of claim 13 wherein the organic is a coupler solvent.

17. The method of claims 1 wherein the coupler solvent employed in the preparation of the dispersion is the same as the coupler solvent employed to remove the auxiliary coupler solvent by passing over the other surface of the microporous membrane.

18. The method of claim 1 wherein the concentration of the auxiliary coupler solvent is reduced to less than 1% weight percent.

19. The method of claim 18 wherein the concentration of the auxiliary coupler solvent is reduced to less than 0.3 weight percent.

20. The method of claim 18 wherein the concentration of the auxiliary coupler solvent is reduced to less than 0.1 weight percent.

21. The method of claim 1 wherein the microporous membrane is a plurality of hollow fibers having a lumen side and a shell side.

22. The method of claim 21 wherein the dispersion is flowed on the lumen side and the coupler solvent is flowed on the shell side.

23. The method of claim 21 wherein the direction of flow on the lumen side is countercurrent to the direction of flow on the shell side.

24. The method of claim 21 wherein the direction of flow on the lumen side is cocurrent to the direction of flow on the shell side.

25. The method of claim 1 wherein the direction of flow on the lumen side is transverse to the direction of flow on the shell side.

26. The method of claim 1 wherein the process is conducted in series with an aqueous membrane separation across a hydrophilic membrane.

27. The method of claim 26 wherein the aqueous membrane separation precedes the solvent extraction step.

* * * * *